US012673755B2

(12) United States Patent
Gallas et al.

(10) Patent No.: US 12,673,755 B2
(45) Date of Patent: Jul. 7, 2026

(54) SYSTEM FOR CONTROLLING AERAULIC CONDITIONS ABOVE A LANDING OR DECK-LANDING ZONE

(71) Applicant: OFFICE NATIONAL D'ETUDES ET DE RECHERCHES AÉROSPATIALES, Palaiseau (FR)

(72) Inventors: Quentin Gallas, Palaiseau (FR); Elvina Derhille, Palaiseau (FR)

(73) Assignee: OFFICE NATIONAL D'ETUDES ET DE RECHERCHES AÉROSPATIALES, Palaiseau (FR)

( * ) Notice: Subject to any disclaimer, the term of this patent is extended or adjusted under 35 U.S.C. 154(b) by 360 days.

(21) Appl. No.: 18/547,099

(22) PCT Filed: Feb. 28, 2022

(86) PCT No.: PCT/FR2022/050350

§ 371 (c)(1),
(2) Date: Aug. 18, 2023

(87) PCT Pub. No.: WO2022/189723

PCT Pub. Date: Sep. 15, 2022

(65) Prior Publication Data

US 2024/0132185 A1 Apr. 25, 2024
US 2024/0227992 A9 Jul. 11, 2024

(30) Foreign Application Priority Data

Mar. 10, 2021 (FR) ..... 2102253

(51) Int. Cl.
*B63B 35/50* (2006.01)

(52) U.S. Cl.
CPC ..... *B63B 35/50* (2013.01); *B63B 2241/20* (2013.01)

(58) Field of Classification Search
CPC ..... B63B 35/50; B63B 35/53
See application file for complete search history.

(56) References Cited

U.S. PATENT DOCUMENTS 7,040,247 B2 * 5/2006 Chouery ..... B63B 35/50 244/116
8,608,107 B2 * 12/2013 Martensson ..... G05D 1/0858 244/114 R (Continued)

FOREIGN PATENT DOCUMENTS

CN 109254585 A 1/2019
DE 102015004086 A1 10/2016

(Continued)

OTHER PUBLICATIONS

International Search Report for PCT/FR2022/050350 mailed May 25, 2022, 5 pages.

(Continued)

*Primary Examiner* — Michael L Sehn
(74) *Attorney, Agent, or Firm* — NIXON & VANDERHYE

(57) ABSTRACT

A system for controlling aeraulic conditions existing above an aerial arrival zone includes anemometric components and aeraulic components. The anemometric components deliver speed and bearing angle values that characterize a relative wind speed with respect to the aerial arrival zone and to a superstructure located close to the aerial arrival zone. The aeraulic components are capable of modifying air movements above the aerial arrival zone, and are controlled according to the wind speed and bearing angle values. Such a system is particularly suitable for use on board a ship able to carry a helicopter, in particular on its afterdeck.

12 Claims, 4 Drawing Sheets

(56) References Cited

U.S. PATENT DOCUMENTS

| | | | | |
|---|---|---|---|---|
| 2014/0350754 | A1 | 11/2014 | Elgersma et al. | |
| 2019/0235525 | A1* | 8/2019 | Cooper | H01Q 1/28 |
| 2019/0270525 | A1* | 9/2019 | Baury | B63B 35/50 |
| 2019/0383052 | A1 | 12/2019 | Blake et al. | |
| 2020/0094948 | A1 | 3/2020 | Adachi et al. | |

FOREIGN PATENT DOCUMENTS

| | | | |
|---|---|---|---|
| EP | 2843420 | A1 | 3/2015 |
| FR | 2912159 | A1 | 8/2008 |
| FR | 2931440 | A1 | 11/2009 |
| JP | 2020045049 | A | 3/2020 |
| KR | 101527568 | B1 | 6/2015 |
| RU | 2088487 | C1 | 8/1997 |

OTHER PUBLICATIONS

Written Opinion of the ISA for PCT/FR2022/050350 mailed May 25, 2022, 6 pages.

Office Action, issued in Japanese Patent Application No. 2023-555323 dated Feb. 3, 2026.

* cited by examiner

SYSTEM FOR CONTROLLING AERAULIC CONDITIONS ABOVE A LANDING OR DECK-LANDING ZONE

CROSS-REFERENCE TO RELATED APPLICATIONS

This application is the US national stage of PCT/FR2022/050350, filed Feb. 28, 2022 and designating the United States, which claims the priority of FR 2102253, filed Mar. 10, 2021. The entire contents of each foregoing application are incorporated herein by reference.

TECHNICAL FIELD

This description relates to a system for controlling aeraulic conditions which exist above a landing or deck-landing zone.

PRIOR ART

The landing of aircrafts such as helicopters or multicopter-type drones can be disrupted or made difficult by airflow conditions that generate air vortices and/or recirculations. Such conditions manifest in particular when the landing zone is located near a superstructure which acts as an obstacle to wind flow. When the superstructure is located on the side where the wind is coming from in relation to the landing zone, and when the wind speed is sufficient, an air recirculation bubble appears above the landing zone. The direction and speed of the air flow then vary over very short distances inside such an air recirculation bubble, so the terminal phase of landing becomes difficult or dangerous. As is known, continuous or intermittent air vortices can also appear that originate from upper angles of the superstructure, and cause additional disruptions in landing.

These difficulties can be particularly critical when landing an aircraft on a ship, for example a helicopter-carrier frigate. Indeed, the ship may have a superstructure which is close to the deck-landing zone, and the relative wind speed with respect to the deck-landing zone can be high, in particular when the ship is moving in the open sea. In a conventional frigate configuration where there is an afterdeck, the deck-landing zone for the helicopter is located on the frigate's afterdeck, behind a hangar which forms a superstructure relative to the level of the deck-landing zone. However, many other arrangements intended to allow the arrival of an aircraft have similar configurations, with the same resulting difficulties and dangers for the terminal phase of the aircraft's arrival.

Document DE 10 2015 004086 A1 relates to a device for moving a helicopter on a deck-landing surface, which is equipped with means for measuring the speed and direction of the wind.

Document FR 2 912 159 A1 relates to a helicopter landing platform which is foldable, on a ship.

Document RU 2 088 487 C1 discloses an anemometric measurement system for measuring the wind in front of a ship after an aircraft has landed on a platform of this ship.

Technical Problem

An object of the present invention is then to facilitate and/or improve the safety of the landing or deck-landing of an aircraft for such environmental configuration of the landing or deck-landing zone.

An ancillary object of the invention is to provide such improvement in the landing or deck-landing conditions while minimizing the consumption of energy used for this purpose.

Another ancillary object is to provide a system for improving safety in the landing or deck-landing of an aircraft, which is robust, simple to implement, and which can be easily installed on board a ship, in particular aboard a helicopter-carrier frigate.

SUMMARY OF THE INVENTION

To achieve at least one of these or other objects, a first aspect of the invention proposes a system for controlling aeraulic conditions which exist above a surface for the landing or deck-landing of an aircraft, referred to as an aerial arrival zone. The system is adapted for use when the aerial arrival zone is located close to a superstructure, along an alignment axis which is oriented from the aerial arrival zone towards the superstructure, the superstructure extending vertically higher than the aerial arrival zone and being capable of altering a wind flow above the aerial arrival zone. This system comprises:

- anemometric means, adapted to provide speed and bearing angle values which characterize a relative speed of the wind with respect to the aerial arrival zone and the superstructure;
- aeraulic means, which are arranged close to the aerial arrival zone, and are capable of modifying air movements above this aerial arrival zone; and
- a controller, adapted to activate the aeraulic means when the speed value which is supplied by the anemometric means is greater than a first non-zero threshold, and/or the absolute value of the bearing angle value which is also supplied by the anemometric means is less than a second non-zero threshold.

The system of the invention is thus capable of improving the landing or deck-landing conditions of the aircraft in the aerial arrival zone when the relative wind speed with respect to this zone is high, or when its bearing angle is small or not too high. In other words, the aeraulic means are activated for a selection of unfavorable landing or deck-landing conditions, and can be kept inactive when the aeraulic conditions which result from the wind and from the position of the superstructure relative to the wind and to the aerial arrival zone do not fall within this selection. The energy consumption by the system of the invention is thus limited to wind conditions—strength and direction of the wind—for which it is useful and efficient.

The first threshold, to which the wind speed value is compared for possible activation of the aeraulic means, can be between 5 $m \cdot s^{-1}$ (meters per second) and 20 $m \cdot s^{-1}$, and the second threshold, which concerns the bearing angle value, can be between 0° (degrees) and 90°.

The anemometric means may be adapted to measure the speed and bearing angle values which characterize the relative speed of the wind with respect to the aerial arrival zone and the superstructure. In other words, it may be sensors which initially measure the speed and the bearing angle of the wind, in real time or at predefined moments. In the context of the invention, the bearing angle of the wind designates the angle formed with the axis of alignment in a horizontal plane, a direction which is parallel to the wind flow as this flow exists in the absence of the superstructure, and which is oriented towards the upstream of this wind flow.

Alternatively, the anemometric means may be adapted to provide wind speed and bearing angle values based on meteorological data which are received elsewhere, and possibly combining this meteorological data with position, orientation, and movement data for the assembly which incorporates the superstructure and the aerial arrival zone.

In general for the invention, and in the absence of any indication to the contrary, the wind speed and bearing angle relate to the wind as it appears within a reference frame which is tied to the superstructure and to the aerial arrival zone. In cases where the assembly that groups this superstructure and aerial arrival zone is stationary on Earth, the wind speed and bearing angle used for the invention are relative to the terrestrial reference frame. In other cases where the assembly of superstructure and aerial arrival zone is mobile on Earth, the wind speed and bearing angle which are used for the invention are those which exist within the reference frame which is tied to this assembly, their values then being different from those relating to the terrestrial reference frame.

The aeraulic means may comprise, in a non-limiting manner, continuous or intermittent blowing means, including shutters and means for directing air jets, continuous or intermittent suction means, airflow deflection means, etc. They are advantageously arranged at at least one location on the periphery of a face of the superstructure which is oriented towards the aerial arrival zone. For embodiments of the invention which use blowing means, an air blowing speed which these produce can be between 0.4 times and 3 times the wind speed as supplied by the anemometric means. This air blowing speed may in particular be adjusted by the system controller.

First embodiments of the invention may be more particularly intended to limit a vertical extension of an air recirculation bubble which is generated by wind above the aerial arrival zone. For this purpose, the aeraulic means may comprise blowing and/or suction means arranged along a substantially horizontal upper edge, and possibly also along substantially vertical side edges, of the superstructure face which is oriented towards the aerial arrival zone. The controller is then adapted to activate the aeraulic means when the speed value supplied by the anemometric means is greater than the first threshold, and when the absolute value of the bearing angle supplied by the anemometric means is less than a third threshold, so as to lower the upper boundary of the air recirculation bubble, or to increase a downward inclination of this upper boundary which starts from the upper edge of the superstructure face. A portion of the aerial arrival zone which is furthest from the superstructure thus becomes cleared of the air recirculation bubble. Landing or deck-landing conditions in this portion of the aerial arrival zone are improved in this manner. For such first embodiments of the invention, the third threshold may be between 0° and 10°.

Second embodiments of the invention may be more particularly intended to transversely push back the air recirculation bubble generated by wind above the aerial arrival zone. For this purpose, the aeraulic means may comprise blowing and/or suction means arranged along the substantially vertical side edges of the superstructure face which is oriented towards the aerial arrival zone. The controller is then adapted to activate at least part of the aeraulic means when the speed value supplied by the anemometric means is greater than a fourth non-zero threshold, and when the absolute value of the bearing angle supplied by the anemometric means is greater than a fifth non-zero threshold and less than 90°. In this manner, an angle which exists between the superstructure face which is oriented towards the aerial arrival zone and a boundary of the air recirculation bubble, is reduced. The air recirculation bubble is then contained within this angle, which is measured at the one among the substantially vertical side edges which is on the same side as the direction from which the wind is coming relative to the alignment axis. Thus, a lateral angular sector of the aerial arrival zone which is located on the same side of the alignment axis as the direction from which the wind is coming, said to be located upwind, becomes cleared of the air recirculation bubble. The landing or deck-landing conditions are then again improved, although in a manner which differs from that of the first embodiments of the invention. For such second embodiments of the invention, the fourth threshold may be between 5 $m \cdot s^{-1}$ and 20 $m \cdot s^{-1}$, and the fifth threshold may be between 10° and 90°. Optionally, the controller may be adapted to activate only part of the blowing and/or suction means which are arranged along the substantially vertical side edges, this part of the blowing and/or suction means which is activated being determined by the controller according to the bearing angle value of the wind.

Finally, third embodiments of the invention may be more particularly intended to interfere with the wind-generated vortices originating from the upper lateral angles of the superstructure face. For this purpose, the aeraulic means may comprise blowing and/or suction means arranged at upper lateral angles of the superstructure face which is oriented towards the aerial arrival zone. In this case, the controller is adapted to activate the aeraulic means when the speed value supplied by the anemometric means is greater than a sixth non-zero threshold, and the absolute value of the bearing angle as supplied by the anemometric means is less than 5°, so as to disrupt the vortices. For such third embodiments of the invention, the sixth threshold may be between 5 $m \cdot s^{-1}$ and 20 $m \cdot s^{-1}$.

In general for the invention, the controller may be adapted to adjust an operation of the aeraulic means in real time according to pressure values repeatedly measured by barometric means located close to the aerial arrival zone.

According to another possibility, the controller determines the operation of the aeraulic means on the basis of values initially supplied by the anemometric means, and possibly also by the barometric means, then orders the execution of this operation in an open loop.

Additional parameters such as a characterization of ocean conditions may also be taken into account in determining or adjusting the operation of the aeraulic means, when the invention is used on board a ship.

Finally, a second aspect of the invention proposes a landscaped structure which comprises:

- an aerial arrival zone adapted for an aircraft, in particular a helicopter or a drone with vertical rotor axes, to land on this aerial arrival zone;
- a superstructure which is located close to the aerial arrival zone, this superstructure extending vertically higher than the aerial arrival zone and being capable of altering the wind flow above said zone; and
- a system for controlling the aeraulic conditions which exist above the aerial arrival zone, this system being in accordance with the first aspect of the invention.

Such landscaped structure may be part of a ship, in particular part of a ship's afterdeck, part of an aircraft carrier's flight deck for landing and takeoff, part of an offshore platform, also called an oil platform, part of a building, in particular when the structure is located on a tower or a hospital building, and part of an airport, airfield, or heliport.

BRIEF DESCRIPTION OF FIGURES

The features and advantages of the invention will become more clear from the following detailed description of some non-limiting embodiments, with reference to the appended figures, which include.

DETAILED DESCRIPTION OF THE INVENTION

For clarity sake, the dimensions of the elements represented in the figures correspond neither to actual dimensions nor to actual dimensional ratios. Furthermore, some of these elements are only represented symbolically, and identical references indicated in different figures designate elements which are identical or which have identical functions.

Figure 1A:
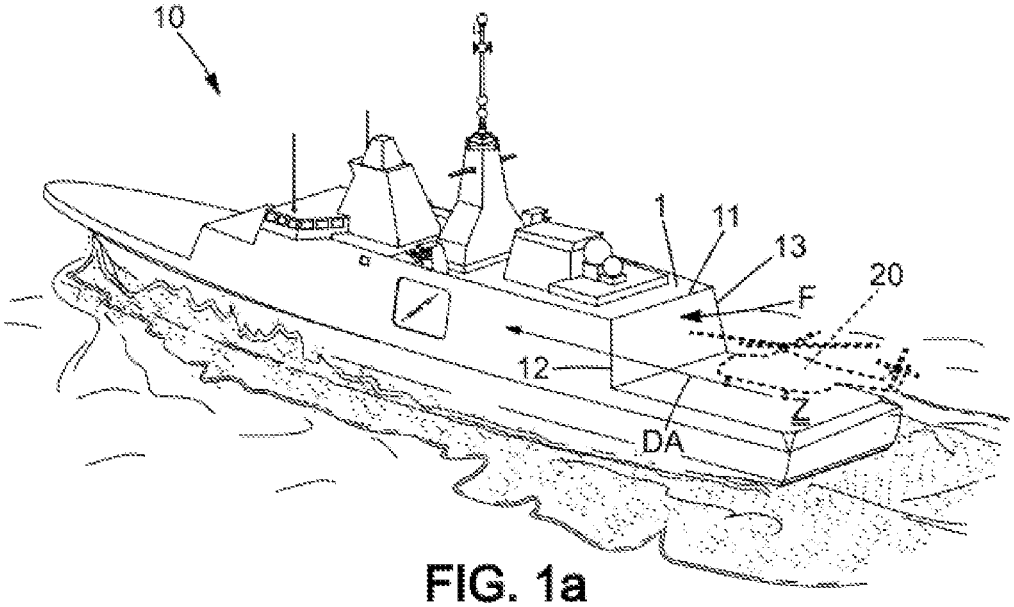
FIG. 1*a* illustrates an application of the invention in a helicopter carrier.

The invention is now described in the case of an application in a helicopter-carrier frigate of the afterdeck type, by way of illustration. Such a ship is designated by the reference 10 in [FIG. 1*a*] and [FIG. 1*b*]. It comprises an aerial arrival zone Z on which a helicopter 20 can land. Aerial arrival zone Z is composed of a horizontal deck surface, which is located in a rear part of ship 10. Ship 10 further comprises a superstructure 1 in its central part, such that aerial arrival zone Z is located just behind superstructure 1 relative to the axis of ship 10. DA designates the axis of alignment of superstructure 1 with aerial arrival zone Z, directed from aerial arrival zone Z towards superstructure 1. Superstructure 1 has a face F which is oriented towards aerial arrival zone Z, and which is substantially vertical. References 11, 12, and 13 respectively designate the upper edge of face F, which is substantially horizontal, and the two side edges of face F, which are substantially vertical. For ship 10, direction DA can correspond to its longitudinal direction, from aft to front, side edge 12 is on the port side, and side edge 13 is on the starboard side. Superstructure 1 can be an on-board hangar.

Figure 1B:
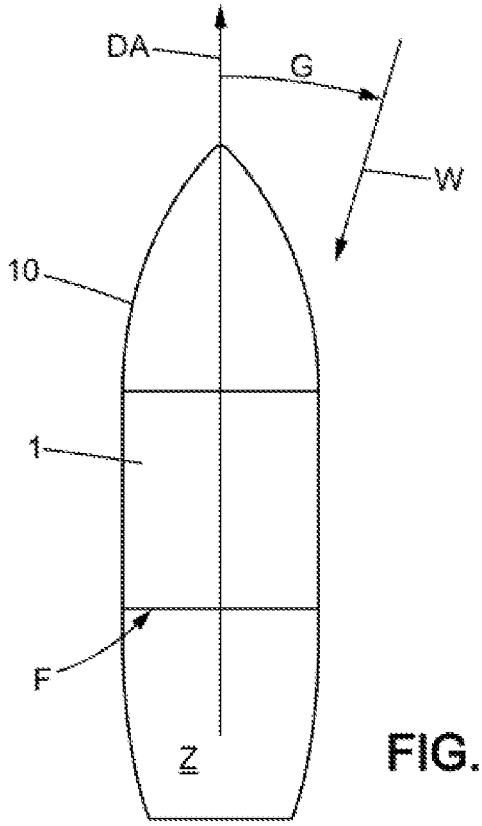
FIG. 1*b* is a plan view which shows useful directions for the invention.

In accordance with [FIG. 1*b*], W designates the wind flow direction at the location where ship 10 is positioned, so this wind flow direction exists in the absence of ship 10. In other words, W does not take into account airflow disruptions that ship 10, in particular its superstructure 1, can generate. G designates the bearing angle of the wind at the position of ship 10: it identifies the direction from which the wind is coming relative to alignment axis DA within a horizontal plane, being counted as positive on the starboard side and negative on the port side for example. In addition to its bearing angle G, the wind is characterized by its speed value V as it exists without taking into account the disruptions generated by ship 10 on the wind flow. In general for the invention, the wind speed V and bearing angle G are determined within a reference frame which is tied to superstructure 1 and aerial arrival zone Z, these having fixed relative positions with respect to one another. In other words, in the case of the application considered in ship 10, the wind speed V and bearing angle G are determined within the reference frame of ship 10. Depending on a possible movement of ship 10 with respect to the terrestrial reference frame, the values to be considered for the invention for wind speed V and bearing angle G result from vector subtraction of the speed of ship 10 from that of the wind, as these two speeds exist as vectors in the terrestrial reference frame.

Figure 2:
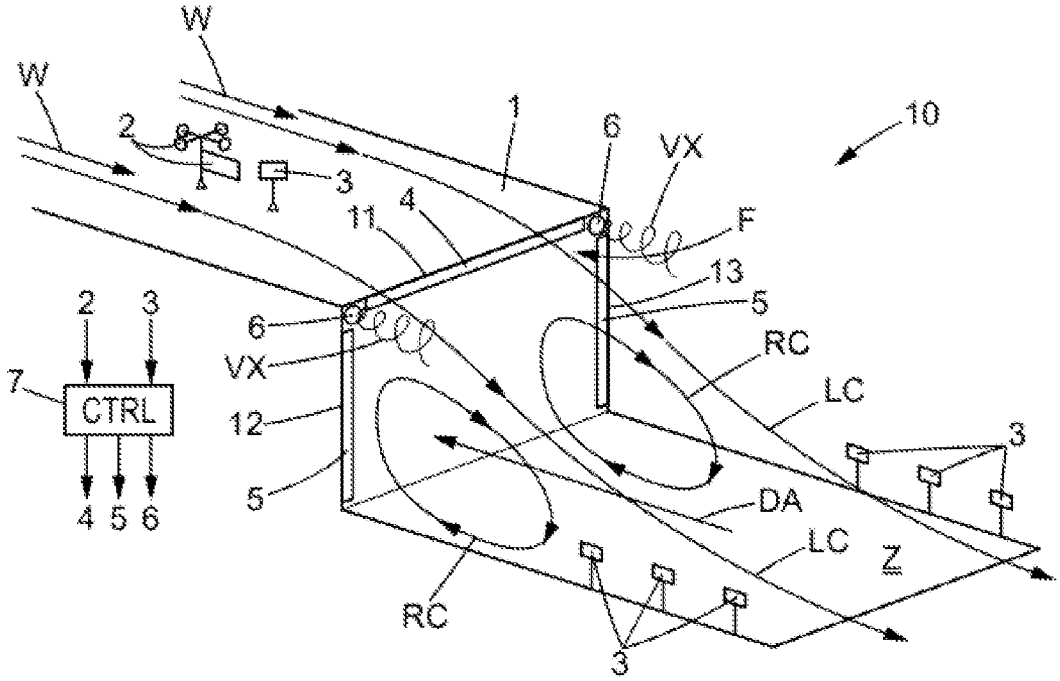
FIG. 2 is a perspective diagram which shows an air recirculation bubble and vortices generated by wind behind a superstructure, as well as positions of anemometric and barometric sensors that are useful for the invention.

FIG. 2 shows disruptions in the wind flow which are caused by superstructure 1 above aerial arrival zone Z. These disruptions are shown in this figure for the case where bearing angle G is zero. They appear when there is sufficient wind speed V.

Figure 3A:
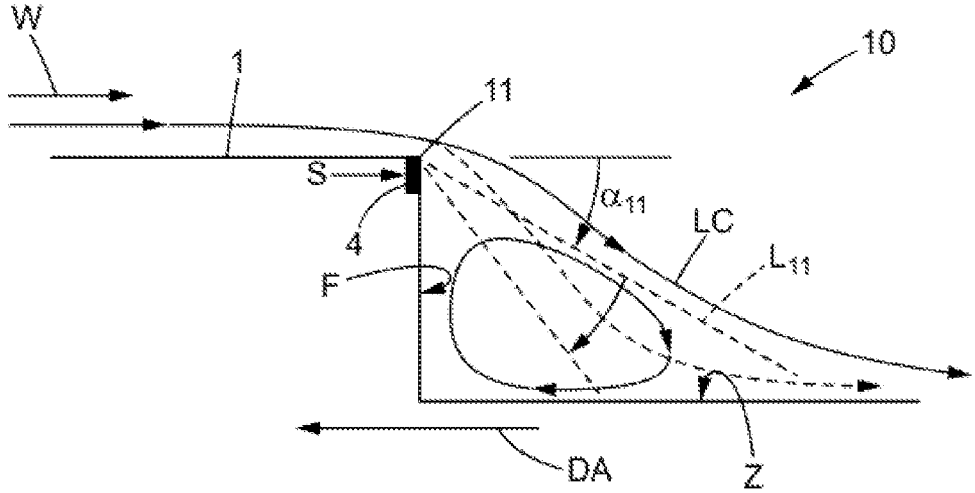
FIG. 3*a* is a side view diagram which illustrates an efficiency of a system according to the invention for first possible operations.

A first disruption consists of the appearance of an air recirculation bubble, as designated by RC in the figure. This air recirculation bubble RC appears in the re-entrant angle formed by aerial arrival zone Z with the face F which is oriented towards it. It generates locally, above aerial arrival zone Z, a descending vertical air flow which can be particularly hazardous for helicopter 20 during its landing. Air recirculation bubble RC is bounded at the top by streamlines LC which originate from the wind existing above superstructure 1 and which gradually descend above aerial arrival zone Z towards the stern of ship 10. This upper boundary of air recirculation bubble RC, which starts from upper edge 11 of face F, is designated by the reference $L_{11}$ in [FIG. 3*a*]. Similarly, air recirculation bubble RC has two lateral boundaries on the port and starboard sides which respectively start from side edges 12 and 13 of face F.

A second disruption consists of the appearance of vortices VX coming from the upper angles of face F, where edges 11 and 12 meet on the port side and where edges 11 and 13 meet on the starboard side. These vortices VX have cores that extend downwind in the wind flow, and for this reason are referred to as longitudinal vortices.

FIG. 2 also shows anemometric means with which ship 10 is equipped in order to implement the invention, for the purposes of measuring wind speed V and bearing angle G. In a known manner, such anemometric means can comprise a wind vane and wind cups which are jointly designated by the reference 2. Other known types of anemometers can alternatively be used, including one or more laser doppler anemometer(s). These anemometric means can advantageously be located on superstructure 1, in order to characterize the wind within the reference frame of ship 10 without the results of this characterization being significantly altered by the presence of ship 10 itself.

Barometric probes 3 can optionally be added on board ship 10, in particular to measure the air pressure in the vicinity of aerial arrival zone Z. Such barometric probes can be placed on the port and starboard sides of aerial arrival zone Z in order to characterize the positions of the boundaries of air recirculation bubble RC, but in addition also on superstructure 1.

For the invention, ship 10 is further equipped with aeraulic means capable of modifying the air flow which is due to wind above aerial arrival zone Z. These aeraulic means may comprise in particular blowing and/or suction systems (not shown), as well as openings or slots through which air can be blown or suctioned. In [FIG. 2], the reference 4 designates a blowing and/or suction slot which is located along upper edge 11 of face F, the references 5 designate two blowing and/or suction slots which are respectively located along side edges 12 and 13 of face F, and the references 6 designate two blowing nozzles which are respectively located at the upper corners of face F, meaning where edges 11 and 12 meet and where edges 11 and 13 meet. Possibly, the aeraulic means can further be adapted to modify the directions of air flows which are blown or suctioned through slots 4 and 5, or emitted by nozzles 6.

In general for the invention, the aeraulic means can consist of any type of fluidic actuators, such as pulsed jets, synthetic jets, sweeping jets, pumping systems, or baffles. Pulsed jets, which can use valve or flapper mechanisms, and synthetic jets with electromagnetic membranes may be adapted to operate at frequencies of between 5 Hz (hertz) and 500 Hz. Alternatively, synthetic jets with piezoelectric membranes and sweeping jets can be used with operating frequencies of between 500 Hz and 3000 Hz. Possible pumping systems are vacuum pump type systems, and possible baffles are those in particular with adjustable tilting flaps, vanes, and/or honeycombs. For the application of the invention in ship 10, the supply of energy to the aeraulic means can be controlled by the electronic power control of the ship, designated by EPC, this being supplied with energy by a dedicated power supply network, for example at an electrical voltage of 12-14 V (volts), either from batteries or by being connected to the ship's internal power supply grid.

A controller 7, denoted CTRL, is arranged to control the aeraulic means according to the values supplied by anemometric means 2, and possibly also according to those supplied by barometric probes 3. Other additional data which can also be taken into account by controller 7 for controlling the aeraulic means are meteorological data transmitted by an external source to ship 10, data on the movement of ship 10, data which characterize the ocean conditions, in particular data which characterize the pitch, roll, and yaw movements of ship 10, data which relate to the approach path of helicopter 20 and its instantaneous position, data which characterize the size and weight of helicopter 20, etc. Controller 7 is designed and connected in order to control airflows blown or suctioned by each of slots 4 and 5, and by each of nozzles 6. In the case of ship 10, controller 7 may consist of a module of the electronic control unit on board the ship, or ECU.

In general, controller 7 only activates the aeraulic means in order to modify air movements existing above aerial arrival zone Z when wind speed V is greater than a first threshold, and/or wind bearing angle G is below a second threshold. The first threshold can be between 5 $m \cdot s^{-1}$ and 20 $m \cdot s^{-1}$, for example equal to 10 $m \cdot s^{-1}$. The values of speed V which are lower than the first threshold are considered insufficient for the wind to significantly disrupt the landing of helicopter 20. Possibly, controller 7 also inhibits the aeraulic means when the value of speed V is too high, if the system is considered to be insufficiently efficient for such a high value. For example, the aeraulic means can be inhibited when wind speed V is greater than 20 $m \cdot s^{-1}$. The second threshold, which concerns bearing angle G, is between 0° and 90°, for example equal to 45°. In other words, the aeraulic means are activated only when the direction from which the wind is coming is located on the bow side of ship 10. The two conditions for activating the aeraulic means, about wind speed and wind bearing angle, can be alternative or cumulative.

Again in general, controller 7 can be designed to activate the aeraulic means only when an aircraft is approaching for deck-landing in aerial arrival zone Z, until the end of the deck-landing. It is possible for controller 7 to be designed to also activate these aeraulic means when an aircraft which initially landed on aerial arrival zone Z is ready for imminent takeoff, and to continue their operation until this aircraft has exceeded one or more distance and/or altitude threshold value(s) relative to ship 10.

Each of the three operations which are now described can be activated only if wind speed V is greater than the first threshold as indicated above, or else, for at least some of these operations, greater than an additional threshold which is dedicated to that operation. In the latter case, the additional speed threshold V which is dedicated to that operation is greater than or equal to the first threshold.

The first operation of the system is adapted to conditions in which bearing angle value G is low, for example less than 8°, this bearing threshold value corresponding to the third threshold which was introduced in the general part of this description. In other words, this first operation is appropriate when wind direction W is superimposed or almost superimposed with alignment axis DA, while being in the opposite direction. In this case, the aeraulic means described above can be controlled by controller 7 to blow air through slot 4. Such blowing through slot 4 has the effect of reducing the size of air recirculation bubble RC, so that its upper boundary $L_{11}$ is lowered by increasing its inclination from upper edge 11 of face F. [FIG. 3*a*] shows such an increase in inclination of upper boundary $L_{11}$ of air recirculation bubble RC. The inclination of upper boundary $L_{11}$ is denoted all, and measured in relation to a plane which is parallel to that of aerial arrival zone Z. In this figure, the reference S designates the blowing of air. As a result, streamlines LC of the wind flow are substantially horizontal in a larger rear portion of aerial arrival zone Z. Preferably, for this first operation, air can also be blown by the two slots 5, at the same time as through slot 4, to further reduce the size of air recirculation bubble RC.

Figure 3C:
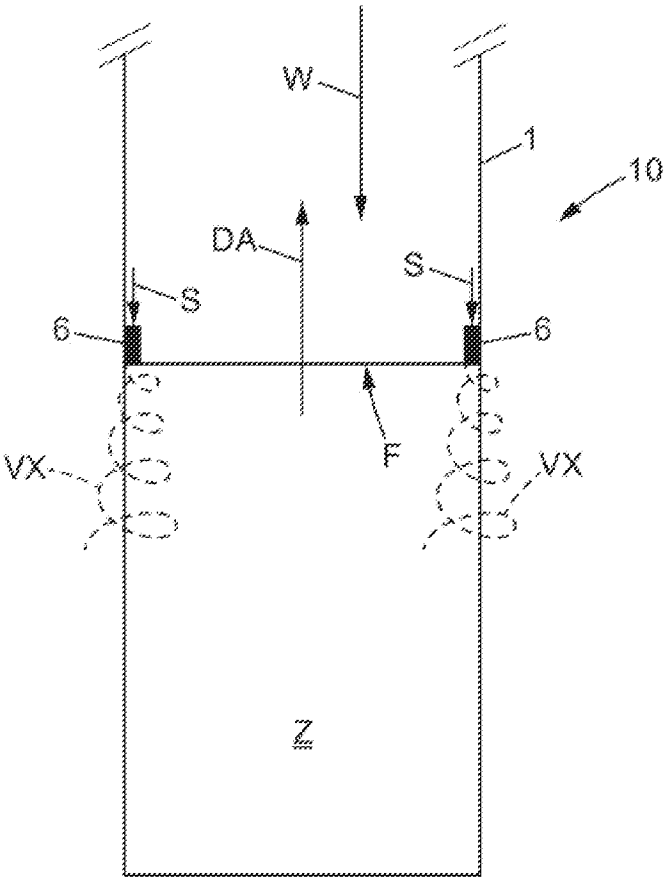
FIG. 3*c* corresponds to FIG. 3*b* for third possible operations.
Figure 3B:
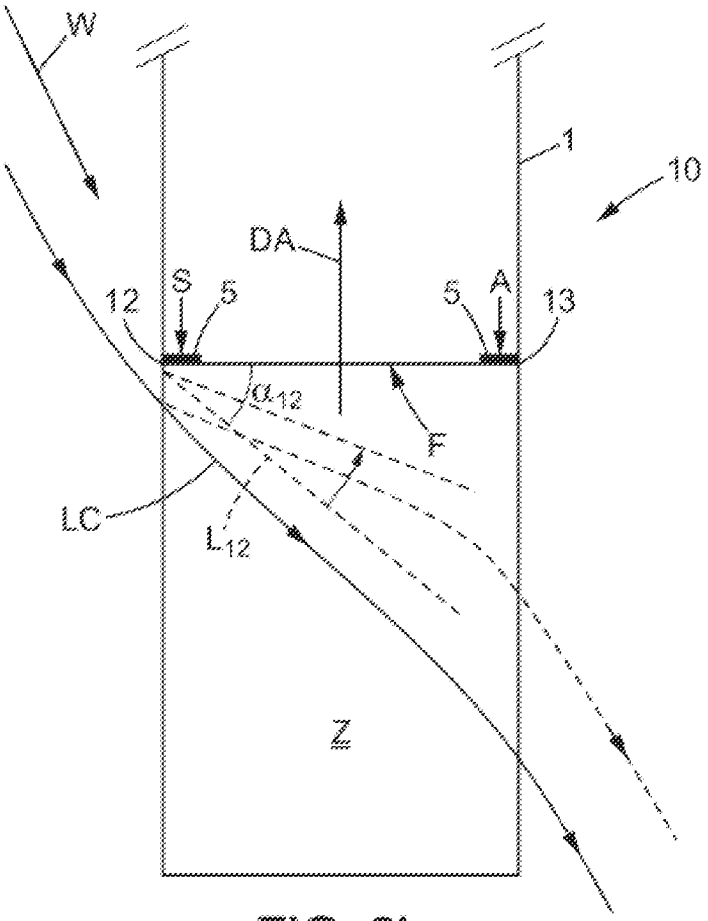
FIG. 3*b* is a plan view diagram which illustrates an efficiency of a system according to the invention for second possible operations.

The second operation of the system is adapted to conditions for which the value of bearing angle G is greater than those concerned by the first operation. For example, this second operation is appropriate when bearing angle G is greater than 20°, this other bearing angle threshold value corresponding to the fifth threshold which was introduced in the general part of this description. In this case, the aeraulic means described above can be controlled by controller 7 to blow air through the one of slots 5 which is on the same side of face F as the direction from which the wind is coming. Such blowing again has the effect of reducing the size of air recirculation bubble RC, but by rotating a lateral boundary thereof around the vertical edge of face F along which the blowing is performed, in the direction of face F. Optionally, air recirculation bubble RC can be further reduced by simultaneous air suction which is carried out by the other slot 5, on the side opposite to that from which the wind is coming. [FIG. 3*b*] illustrates such a second operation, showing the rotation of lateral boundary $L_{12}$ of air recirculation bubble RC. $\alpha_{12}$ designates the angle between lateral boundary $L_{12}$ and face F. The reference S again designates a blowing of air, and the reference A designates a suctioning of air. It is possible for each of side slots 5 to be divided into several successive segments, and the number of segments used for the blowing of air S for this second operation, and possibly also for the suctioning of air A, can be selected by controller 7 according to the value of bearing angle G.

For these first two operations, barometric probes 3 can be used to characterize the size of air recirculation bubble RC, and to adjust the blowing S or suctioning A flow rates in order to reduce this size below predetermined dimensions. It is thus possible, by means of the system of the invention, to ensure that a sufficient portion of aerial arrival zone Z is not under recirculation bubble RC, so that helicopter 20 can land safely.

The third operation of the system is suitable for conditions in which the value of bearing angle G is very low, for example less than 5°. It is possible for this third operation to be activated at the same time as the first operation. It consists of blowing air through nozzles 6, in order to disrupt vortices VX formed by the wind and which start from the upper angles of face F, where edges 11 and 12 meet and edges 11 and 13 meet. Such blowing is efficient in disrupting air vortices VX. It can be continuous, but preferably is intermittent, for example at a frequency which can be adjusted according to the von Kármán constant for the wake of a rounded obstacle. [FIG. 3*c*] illustrates such a third operation. It is thus possible, again by means of the system of the invention, to ensure that air vortices are not likely to disrupt the deck-landing of helicopter 20.

For all these operations, several modes are possible for controller 7: predetermined control modes or adaptive control modes.

Figure 4:
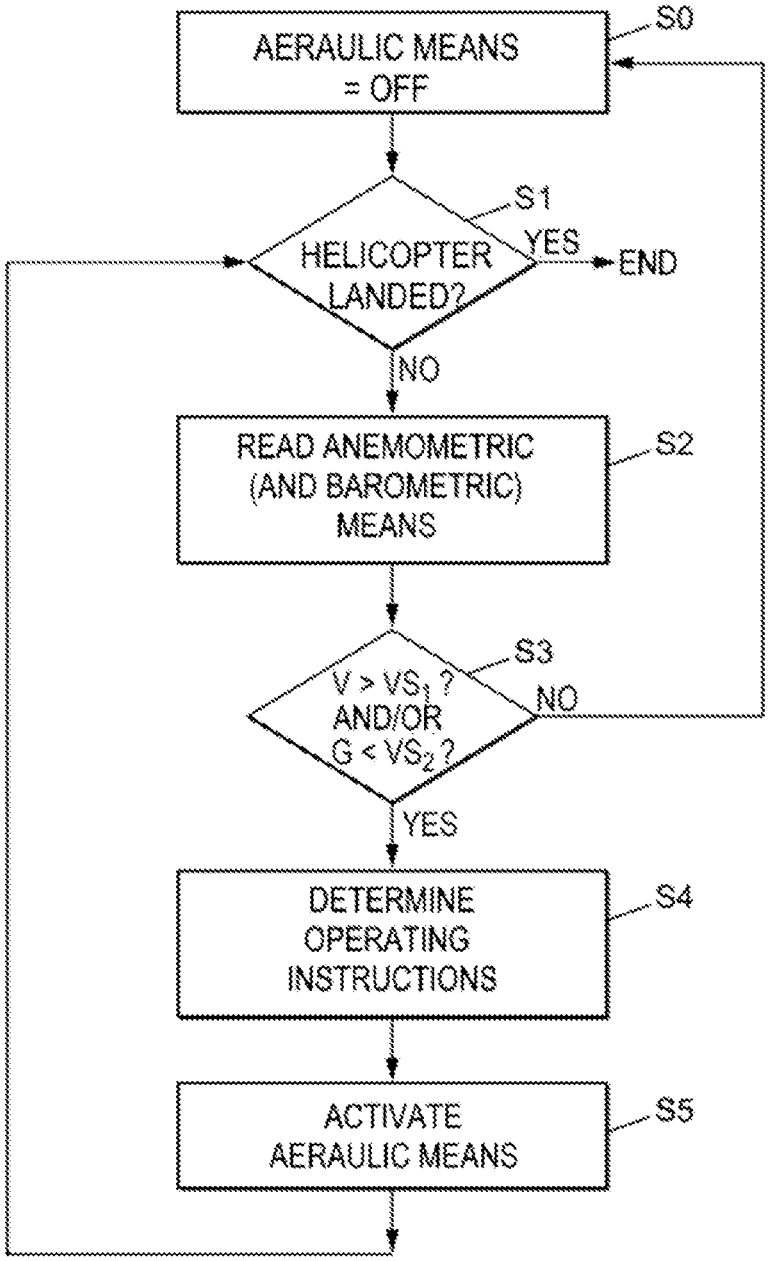
FIG. 4 is a block diagram of operating steps for a system according to the invention.

For a predetermined control mode, controller 7 initially transmits an operating instruction to the aeraulic means, and the latter produce a constant operation which is in accordance with this initial instruction. This instruction may include a selection of the aeraulic means to be activated, air blowing speed and frequency values, one or more air suction speed value(s), and/or one or more orientation value(s) for jets and baffles. The instruction can either be fixed and independent of the values received by controller 7, or variable and determined as a function of several of these values received. For example, the instruction, which may concern several operating parameters of the aeraulic means, can be determined by reading a table or a map in which the entries consist of the values received, these possibly relating to all the data listed above or only some of these data. Using the results of measurements from barometric probes 3 can be particularly relevant, in particular for characterizing the initial size of air recirculation bubble RC. [FIG. 4] shows a possible example of a predetermined control mode. The process of controlling the aeraulic conditions existing above aerial arrival zone Z can be begun when an aircraft is declared to be on approach for deck-landing. In the initial state, corresponding to the reference S0, the aeraulic means are off. Step S1 can consist of checking the progress of the deck-landing of helicopter 20, and the process is continued only if landing has not yet taken place. Step S2 consists of collecting the speed V and bearing angle G values which characterize the wind, as transmitted by the anemometric means. Additional values may possibly also be collected in this step S2, in particular the pressure values delivered by barometric probes 3, as well as other data such as those already listed. Step S3 is the test that checks the conditions necessary for activating the aeraulic means, which concerns the values of the wind speed V and bearing angle G. The process then continues only if speed value V is greater than the first threshold, denoted $VS_1$ in the figure, and/or if bearing angle value G is less than the second threshold, denoted $VS_2$. The operating instructions for the aeraulic means are determined in step S4, then the aeraulic means are activated in accordance with these instructions in step S5. For example, when the aeraulic means comprise blowing means, step S4 can comprise setting an operating force for the latter in which the air blowing speed is between 0.4 times and 3 times the wind speed as measured by anemometric means 2. An operating force for suction means can be set in the same manner, for example with an air suction speed which is also between 0.4 times and 3 times the wind speed. The process can then be repeated starting from step S1.

For an adaptive control mode, the operation of the aeraulic means is controlled in a closed loop. For this purpose, controller 7 is an adaptive controller, for example of the ARMarkov type. The pressure values measured in real time by barometric probes 3 can constitute the input data of the ARMarkov algorithm, and the output data from the algorithm can be the identification of which of the aeraulic means are to be activated, their blowing speed and frequency values, or possibly the suction speed values and/or the orientations of the air jets and/or baffles. A measurement of the difference between the aeraulic conditions which are thus created above aerial arrival zone Z and a reference state which is used as a target, is reinjected as input to the algorithm until a stop criterion is reached. Such a stop criterion can concern, for example, a reduction in the fluctuations of the pressure values as detected by barometric probes 3, or an increase in the static pressure values which exist at the periphery of aerial arrival zone Z.

A predetermined control mode may be preferred in calm weather for the application of the invention in ship 10, while an adaptive control mode may be preferred in rough seas, strong weather, or in the presence of wind gusts.

It is understood that the invention can be reproduced by modifying secondary aspects of the embodiments described in detail above, while retaining at least some of the cited advantages. In particular, the system of the invention can be used for applications other than deck-landing on a ship. Such other applications can be terrestrial, regardless of the nature of the superstructure which is contiguous to the aerial arrival zone. In addition, any numerical values that have been cited are for illustrative purposes only, and may be changed according to the particular application.

The invention claimed is:

1. A system for controlling aeraulic conditions which exist above a surface for landing or deck-landing of an aircraft, referred to as an aerial arrival zone, the system being adapted for use when the aerial arrival zone is located close to a superstructure, along an alignment axis which is oriented from the aerial arrival zone towards the superstructure, the superstructure extending vertically higher than the aerial arrival zone and being capable of altering a wind flow above the aerial arrival zone, said system comprising:

anemometric means, adapted to provide speed and bearing angle values which characterize a relative speed of the wind with respect to the aerial arrival zone and the superstructure, wherein the system further comprises:

aeraulic means, which are arranged close to the aerial arrival zone, and are capable of modifying air movements above said aerial arrival zone; and a controller, adapted to activate the aeraulic means when at least one of the following two conditions is satisfied: the speed value which is supplied by the anemometric means is greater than a first non-zero threshold, and the absolute value of the bearing angle value which is supplied by said anemometric means is less than a second non-zero threshold.

2. The system of claim 1, wherein the first threshold is between 5 $m \cdot s^{-1}$ and 20 $m \cdot s^{-1}$, and the second threshold is between 0° and 90°.

3. The system of claim 1, wherein the anemometric means are adapted to measure the speed and bearing angle values which characterize the relative speed of the wind with respect to the aerial arrival zone and the superstructure (1).

4. The system of claim 1, wherein the aeraulic means is selected from the group consisting of: continuous or intermittent blowing means, continuous or intermittent suction means, and airflow deflection means; and are arranged at at least one location on the periphery of a face of the superstructure which is oriented towards the aerial arrival zone.

5. The system of claim 4, wherein the aeraulic means comprise blowing and/or suction means arranged along a substantially horizontal upper edge of the face of the superstructure which is oriented towards the aerial arrival zone, and the controller is adapted to activate the aeraulic means when the speed value supplied by the anemometric means is greater than the first threshold, and when the absolute value of the bearing angle supplied by said anemometric means is less than a third threshold, so as to lower an upper boundary of an air recirculation bubble which is generated by the wind above the aerial arrival zone, or to increase a downward inclination of said upper boundary of the air recirculation bubble which starts from the upper edge of the face of the superstructure.

6. The system of claim 5, wherein the third threshold is between 0° and 10°.

7. The system of claim 4, wherein the aeraulic means comprise blowing and/or suction means arranged along substantially vertical side edges of the face of the superstructure which is oriented towards the aerial arrival zone, and the controller is adapted to activate at least part of the aeraulic means when the speed value supplied by the anemometric means is greater than a fourth non-zero threshold, and when the absolute value of the bearing angle supplied by said anemometric means is greater than a fifth non-zero threshold and less than 90°, so as to reduce an angle between the face of the superstructure which is oriented towards the aerial arrival zone and a boundary of an air recirculation bubble which is generated by the wind above a portion of the aerial arrival zone, said air recirculation bubble being contained within said angle, and said angle being measured at the one among the substantially vertical side edges which is on the same side as the direction from which the wind is coming relative to the alignment axis.

8. The system of claim 7, wherein the fourth threshold is between 5 $m \cdot s^{-1}$ and 20 $m \cdot s^{-1}$, and the fifth threshold is between 10° and 90°.

9. The system of claim 4, wherein the aeraulic means comprise blowing and/or suction means arranged at upper lateral angles of the face of the superstructure which is oriented towards the aerial arrival zone, and the controller is adapted to activate the aeraulic means when the speed value supplied by the anemometric means is greater than a sixth non-zero threshold, and the absolute value of the bearing angle as supplied by said anemometric means is less than 5°, so as to disrupt vortices generated by the wind and which start from the upper side angles of the face of the superstructure.

10. The system of claim 1, wherein the controller is adapted to adjust an operation of the aeraulic means in real time according to pressure values repeatedly measured by barometric means located close to the aerial arrival zone.

11. A landscaped structure comprising:

the aerial arrival zone adapted for the aircraft, to land on said aerial arrival zone;

the superstructure which is located close to the aerial arrival zone, the superstructure extending vertically higher than the aerial arrival zone and being capable of altering the wind flow above said aerial arrival zone; and the system for controlling aeraulic conditions which exist above the aerial arrival zone, said system being in accordance with claim 1.

12. The landscaped structure of claim 11, constituting one among:

part of a ship;

part of an aircraft carrier's flight deck for takeoff and landing;

part of an off-shore platform;

part of a building; and part of an airport, airfield, or heliport.

* * * * *